United States Patent [19]

Selke

[11] 4,182,349

[45] Jan. 8, 1980

[54] METHOD OF MAKING RECONSTITUTED TOBACCO

[75] Inventor: William A. Selke, Stockbridge, Mass.

[73] Assignee: Kimberly-Clark Corporation, Neenah, Wis.

[21] Appl. No.: 848,431

[22] Filed: Nov. 4, 1977

[51] Int. Cl.[2] ..... A01D 27/00

[52] U.S. Cl. ..... 131/140 C; 131/17 AE

[58] Field of Search ..... 131/17 R, 17 A, 17 AC, 131/17 AD, 17 AE, 31, 79, 109 B, 133 R, 134–135, 140 B, 140 C, 140 P, 142 R, 143, 146, 147 R

[56] References Cited

U.S. PATENT DOCUMENTS

| | | | |
|---|---|---|---|
| 720,830 | 2/1903 | Marsden | 131/140 P |
| 2,626,612 | 1/1953 | Pearce | 131/17 AE |
| 3,098,492 | 7/1963 | Wurzburg et al. | 131/17 AC |
| 3,255,760 | 6/1966 | Selke | 131/140 C |
| 3,297,039 | 1/1967 | Osborne et al. | 131/17 AE |

FOREIGN PATENT DOCUMENTS

| | | | |
|---|---|---|---|
| 1256529 | 12/1971 | United Kingdom | 131/140 P |

*Primary Examiner*—Robert W. Michell
*Assistant Examiner*—C. F. Rosenbaum
*Attorney, Agent, or Firm*—Alan H. Levine

[57] ABSTRACT

Reconstituted tobacco is made from the whole tobacco plant by first separating the woody stalk portion and leaf portion of the plant. The stalk portion is refined, or beaten, apart from the leaf portion to reduce it to pieces which can bond to form a paper-like sheet. The leaf portion is refined to a lesser extent to similarly reduce it. The stalk and leaf portions are combined and formed into a paper-like sheet by a conventional papermaking technique. At least the leaf portion is extracted before refining to separate it into a soluble extract and a fibrous residue, the extract later being introduced into the paper-like sheet. The stalk alone may be refined for a period of time after which the unrefined leaf portion is added to it and the combined stalk and leaf portions then refined together. A part of the stalk portion may be discarded, and conventional non-tobacco papermaking fiber added to the stalk and leaf portions prior to making the paper-like sheet.

7 Claims, No Drawings

METHOD OF MAKING RECONSTITUTED TOBACCO

This invention relates to reconstituted tobacco made by the papermaking process. According to this process, natural tobacco is refined, i.e., beaten, to separate fibers of the tobacco so that a smooth and homogeneous paper-like sheet can be formed from them. Beating also encourages hydrogen bonding between the tobacco fibers which provides coherence to the web.

Prior to beating, the tobacco is usually soaked in hot water to extract the water-soluble portion from it. The aqueous extract is put aside and after the fibrous tobacco remainder is beaten and formed into a paper-like web, the extract is reintroduced into the web.

The different parts of the whole tobacco plant, i.e., the leaf lamina, the leaf midribs, or stems and the stalk, respond very differently to the refining process. After only a little refining, the lamina portion of the leaf tends to break up into finer and finer pieces. In the making of a paper-like web, an aqueous slurry of the refined tobacco is poured through a forming wire or screen, the water passing through the screen and the fibrous material carried by the water remaining on the screen to dry and bond into a self-sustaining sheet. Too much beating causes the lamina pieces to become so small that a large proportion of them pass through the screen with the water and become lost. In addition, extended refining of the lamina portion does not generate strength, as it does when papermaking fibers are refined.

The midribs or stems refined in conventional beating equipment are comminuted adequately and develop the propensity to bond into a strong paper-like sheet when formed and dried. The amount of refining necessary for midribs is, fortunately, not excessive for the lamina portion, so, if necessary for operational simplicity, the lamina and midribs can be refined together.

The stalk of the plant is quite different from the lamina and midribs. Most of the stalk is rather dense and woody. When the plants are grown in the conventional fashion, portions of the stalk have a diameter in excess of three centimeters, and although there is a hollow center, the wall thickness of the woody portion of much of the stalk is in excess of five millimeters. When the plants are grown close together, employing agricultural techniques currently under development, the diameter and wall thickness of the stalk can be reduced sharply, but woody portions still have a thickness over three millimeters. This woody material does not develop suitably when beaten an amount that is appropriate for lamina or even midrib.

When inadequately refined, the stalk portion exists as woody splinters, which do not integrate into the sheet. In the form of these splintery agglomerates, the stalk fibers cannot bond to each other (as do papermaking fiber, when refined) to contribute strength. While the addition of reinforcing fiber, such as flax or chemically prepared softwood, can provide strength as is needed, the need for such additives is precluded by the proper refining of the stalk fiber. This invention provides for subdividing the stalk portion and developing it, so that it contributes to the strength of the final sheet, while not overrefining the lamina portion.

EXAMPLE I

This experiment was run to indicate the problems presented when the whole tobacco plant is treated as a unit.

The material employed was close-grown tobacco of the Virginia, or flue-cured, type produced experimentally by the Canadian Department of Agriculture. One kilogram of this tobacco was taken as a representative sample of the different portions of the plant. It was first broken, by hand and by crushing the heavier pieces with a hammer, into pieces no long than one inch and a half.

The material was then soaked 30 minutes in six liters of water at 90° C. The extract was separated from the insoluble residue by pressing in a hand operated cider press, and the extract collected. Four liters of fresh hot water were then added to the residue, which then soaked 30 minutes. The mixture was again pressed, and the extract collected was added to that obtained from the first pressing. The combined extract was evaporated to concentrate it to a level of 35% solids, by weight and the concentrated extract was put aside for subsequent use.

The fibrous residue, taken from the cider press, was placed in a one gallon Waring blender, water was added to cover the solids and the blender was run at the second highest speed for five minutes. At this point, the largest pieces of stalk were about one centimeter long and one and two millimeters in diameter.

The aqueous slurry of insoluble fibrous portions of the tobacco was then poured into a Valley laboratory beater with a nominal capacity of one and a half pounds. Water was added to bring the consistency to three percent solids. The beater was turned on. Samples of the slurry were taken each 15 minutes over a period of an hour and a half, and these samples were put aside for evaluation by making handsheets.

Handsheets were made in an 8"×8" Noble and Wood handsheet mold, aiming at a basis weight of about 60 gms/sq. meter. The results were as follows:

| Time | Result |
|---|---|
| 15 Min. | Sheet too weak to peel from forming wire; splintery stalk very evident. |
| 30 Min. | Part of sheet peeled from wire, but it was filled with splinters and too weak to handle after drying. |
| 45 Min. | Sheet too weak to handle, and splinters evident. |
| 60 Min. | Sheet weak, splinters evident. |
| 75 Min. | Stock stuck to forming wire and could not be removed as a sheet. The stock was picked and scraped from the wire and dried and weighed. Although 2.50 grams of solids was put in the mold in forming the sheet, the part recovered weighed only 1.78 grams, indicating a loss through the forming wire of 29%. Some splinters were still evident. |
| 90 Min. | Sheet could not be lifted from wire. A few splinters were visible. |

It will be seen that with a relatively small amount of refining, the stalk was not adequately reduced. Hence the sheet contained splinters and was weak because the fibrous material did not bond together sufficiently. With longer beating, the lamina was over-refined and was lost through the forming wire. Also, the sheet stuck to the forming wire.

According to the present invention, these problems are overcome by separating the woody portion of the tobacco plant stalk from the leaf, and refining the woody portion separately and to a greater degree than the leaf.

EXAMPLE II

A kilogram of the same tobacco described in Example I was taken, but the woody portions of stalk were separated by hand from the rest of the tobacco. The pieces of stalk were put in the Waring blender with water and it was run ten minutes at the second highest speed, resulting in reduction of the size of the stalk pieces to a maximum of about a five millimeter length with the maximum diameter about one millimeter. This slurry was transferred to the cider press and the extract removed. The solid residue was then placed in the Valley beater and beaten for 60 minutes. At that time a very few splinter-like pieces were evident.

The tobacco from which the stalk had been separated, i.e., the lamina, midribs, and bark of the stalk, was extracted twice with hot water, and the extract collected as in Example I. After the second extraction, the residue was added to the Valley beater containing the stalk which had been beaten one hour. The combined tobacco was beaten 30 minutes and then the stock was taken for forming handsheets as in Example I. The sheets could be removed from the forming wire and were dried on blotters in a Noble and Wood laboratory handsheet drier.

The extract from the stalk and that from the leaf portion were mixed and concentrated as in Example I. The dried sheets were impregnated by spraying one side with the concentrated extract, drying in a forced circulation over at 105° C., turning over, and repeating the spraying and drying. The resulting sheets were fairly smooth and were strong enough to be handled and flexed. A small number of fine splinters of stalk were apparent.

Since the stalk does not provide the same desirable taste upon burning as the leaf, it may be advantageous to discard a portion of the stalk. The yield of finished tobacco sheet from a given number of tabacco plants will be reduced, but in some circumstances this could be offset by improvement in smoking quality.

EXAMPLE III

The steps of Example II were followed up to the point where the extraction of the leaf was completed. In this case roughly 60% of beaten stalk was removed from the beater and discarded before the leaf portion was mixed with that remaining in the beater. The procedure of Example II was followed, except that the extract obtained from the stalk was discarded and the sheets impregnated with the concentrated extract of the lamina and stem. The resulting sheets were more fragile than thos from Example II, but could be handled and flexed.

Increased mechanical strength of a cigarette tobacco sheet can be of economic importance, as it relates the ability of the tobacco shreds to withstand the rigors of cigarette manufacture without breaking to small fragments which do not fill out cigarettes effectively. The strength of the sheet made in the paper process can be increased easily by the addition of suitable conventional cellulose papermaking fiber.

EXAMPLE IV

The procedure of Example III was followed, except that the extraction step was omitted for the stalk portion and 50 grams of unbleached kraft softwood fiber, sold under the Trademark Domtar Q-90 by the Domtar Corporation, was added to the beater with the leaf and stem. The sheets formed were stronger and more pliable than those of Example III. They were quite similar to those of Example II, but exhibited fewer fine splintery pieces of stalk.

EXAMPLE V

The sheets made in Examples II, III, and IV were individually shredded using a laboratory Himoff tobacco shredder and made into cigarettes using a Bull Durham roller and cigarette papers. These cigarettes were evaluated for taste by a panel of five smokers with the following results of ranking.

| Sample | Average Ranking (1.0 being best) |
|---|---|
| Ex. II | 3.0 |
| Ex. III | 1.4 |
| Ex. IV | 1.6 |

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A method of making reconstituted tobacco from the whole tobacco plant comprising the steps of:
   (a) separating the woody portion of the tobacco plant stalk from the leaf of the tobacco plant,
   (b) refining only the woody stalk portion to reduce it to pieces which can bond to form a paper-like sheet,
   (c) refining the leaf portion of the tobacco plant to a lesser extent than the woody stalk portion is refined to reduce the leaf portion to pieces which can bond to form a paper-like sheet, and
   (d) making an aqueous slurry including both the refined woody stalk portion and the leaf portion and forming a paper-like reconstituted tobacco sheet from the slurry using a conventional papermaking technique.

2. A method as defined in claim 1 including the steps of extracting the leaf portion of the tobacco plant, prior to refining it, to separate the leaf portion into a soluble extract and a fibrous residue, and thereafter introducing the soluble extract into the paper-like sheet.

3. A method as defined in claim 2 including the steps of extracting the woody stalk portion of the tobacco plant, prior to refining it, to separate the woody stalk portion into a soluble extract and a fibrous residue, and thereafter introducing the soluble extract into the paper-like sheet.

4. A method as defined in claim 1 wherein said refining is done by beating the tobacco plant portions.

5. A method as defined in claim 1 including the steps of adding unrefined leaf portion to partially refined woody stalk portion after partial refining of only the woody stalk portion, and thereafter refining the combined woody stalk portion and leaf portion 6. A method as defined in claim 1 including the step of discarding a part of the woody stalk portion prior to combining the woody stalk portion and leaf portion.

7. A method as defined in claim 1 including the step of adding conventional non-tobacco papermaking fiber to the woody stalk and leaf portions prior to forming the paper-like sheet.

* * * * *